US006405832B1

(12) United States Patent
Willis

(10) Patent No.: US 6,405,832 B1
(45) Date of Patent: Jun. 18, 2002

(54) TREE CLIMBING GAFF

(75) Inventor: Derek M. Willis, Yellow Springs, OH (US)

(73) Assignee: Derek Michael Willis, Yellow Springs, OH (US)

( * ) Notice: Subject to any disclaimer, the term of this patent is extended or adjusted under 35 U.S.C. 154(b) by 0 days.

(21) Appl. No.: 09/861,612

(22) Filed: May 22, 2001

(51) Int. Cl.[7] ..... A63B 27/00
(52) U.S. Cl. ..... 182/221; 182/134
(58) Field of Search ..... 182/221, 134

(56) References Cited

U.S. PATENT DOCUMENTS

| | | | |
|---|---|---|---|
| 754,016 | A | 3/1904 | Schmucker |
| 2,357,159 | A | 8/1944 | Bennington |
| 2,484,181 | A | 10/1949 | Munger et al. |
| 4,153,139 | A | 5/1979 | Houch |
| 4,730,702 | A | 3/1988 | Torbett |
| 4,993,515 | A | 2/1991 | Green et al. |
| 5,231,775 | A | 8/1993 | Trent, Jr. |

FOREIGN PATENT DOCUMENTS

| | | |
|---|---|---|
| GB | 177462 | 3/1922 |

*Primary Examiner*—Alvin Chin-Shue
(74) *Attorney, Agent, or Firm*—Denyelle R. Willis

(57) ABSTRACT

A tree-climbing device adapted to be attached to a user's boot. The device is fashioned with two different sized gaffs which are angularly disposed relative to the shank. The size and position of the two gaffs enhance a climbers stability, especially on smaller tree limbs.

4 Claims, 3 Drawing Sheets

TREE CLIMBING GAFF

BACKGROUND OF THE INVENTION

1. Field of the Invention

The present invention generally relates to climbing apparatus. More specifically, the present invention is drawn to a climbing gaff device which is attached to the boots and legs of a climber.

2. Description of the Related Art

Tree-or pole-climbing gaff devices have been utilized for many years by tree trimmers, linesmen, tree surgeons and the like as a means to insure safety while working in the mid to top reaches of trees or electric wire support poles. Conventional gaff devices comprise a stirrup-like member that is adapted to be attached to a boot/shoe and leg of a wearer. A pointed prong is fitted to they stirrup-like member and extends a distance which is approximately even with the horizontal plane of the sole of the boot/shoe. The prong is utilized to grip the trunk of the tree or pole so that a measure of stability is attained while climbing.

Examples of prior art climbing devices are disclosed in U.S. Pat. No. 4,153,139 (Houch), U.S. Pat. No. 4,730,702 (Torbett), U.S. Pat. No. 4,993,515 (Green et al.) and U.S. Pat No. 5,231,775 (Trent). All of the above mentioned devices employ a single prong for climbing stabilization. U.S. Pat. No. 754,616 (Schmucker), U.S. Pat. No. 2,357,159 (Bennington) and U.S. Pat No. 2,484,181 (Munger et al.) show climbing devices having multiple prongs. It is noted however, that all prongs are positioned in the same respective vertical plane.

British Patent number 177,462 discloses a foot iron having spikes disposed on the underside of a base plate. The device of the instant patent is designed to be worn by mountain climbers.

None of the above inventions and patents, taken either singularly or in combination, is seen to disclose a double-pronged, tree-climbing gaff as will subsequently be described and claimed in the instant invention.

SUMMARY OF THE INVENTION

The present invention is an improved tree-climbing gaff device. As contemplated, the invention may be manufactured an sold as a unit or it may be adapted as a replacement or addition to currently used gaff devices.

The climbing structure of the instant invention comprises 20 secondary prong positioned between the primary prong and the share member. The secondary prong is especially useful to tree climber in that it provides a means to grasp tree limbs having a diameter of three and one-half inches or less which has heretofore been configuration and size of the secondary prong, relative to the primary prong, has proven to enhance stability and balance. Further, the secondary prong provides insurance against unexpected disengagement (kickout) of the primary prong from the tree or pole.

Accordingly, it is a principal object of the invention to provide an improved climbing device which especially lends itself to tree climbing and the like.

It is another object of the invention to provide an improved climbing device which permits a user to maintain stability while climbing on smaller tree limbs.

It is a further object of the invention to provide an improved climbing device which can be easily adapted to attach to conventional tree climbing devices.

Still another object of the invention is to provide an improved climbing device which may be quickly and easily attached to a user's legs and feet.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
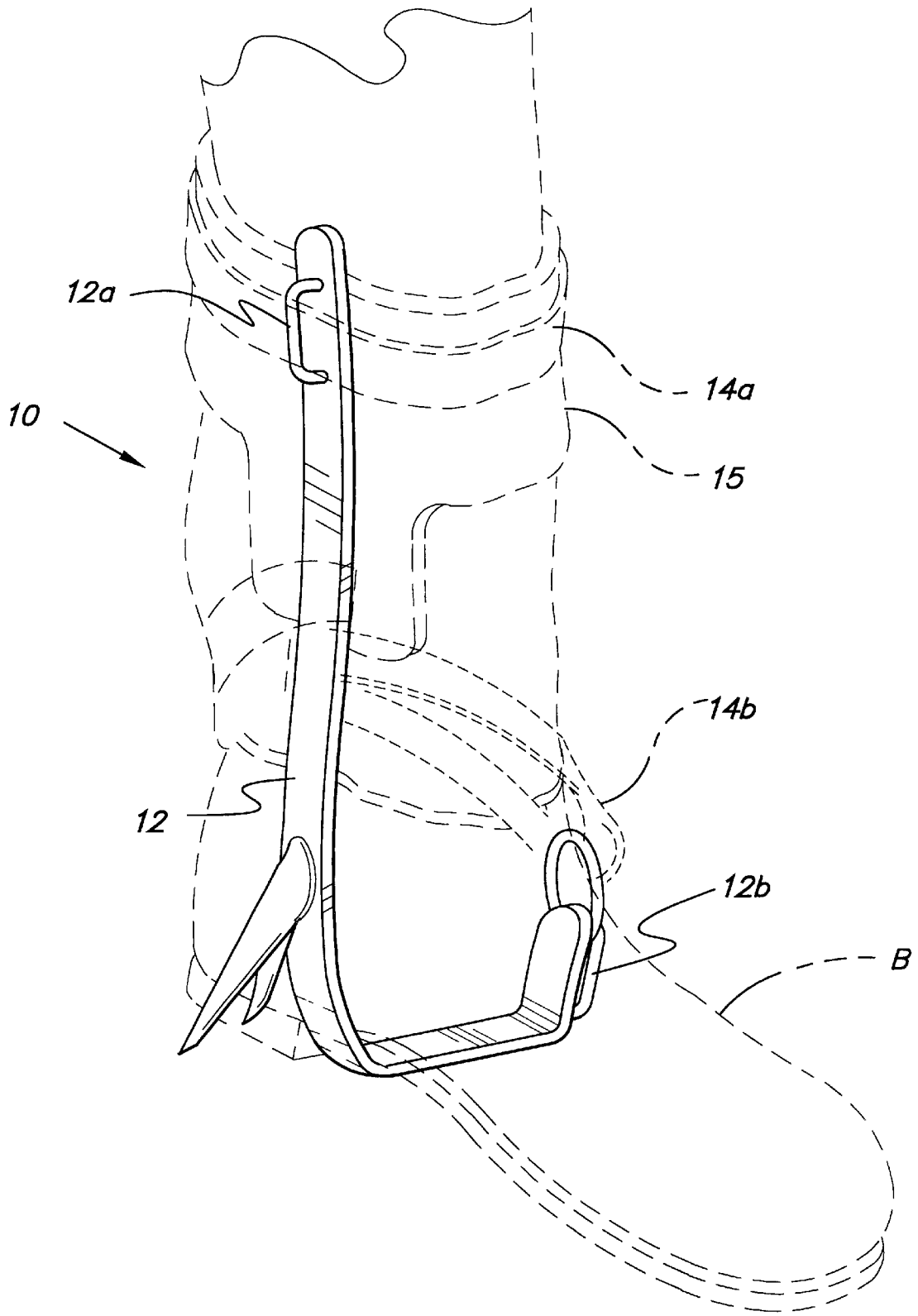
FIG. 1 is an environmental, perspective view of a tree-climbing gaff device according to the present invention.
Figure 2:
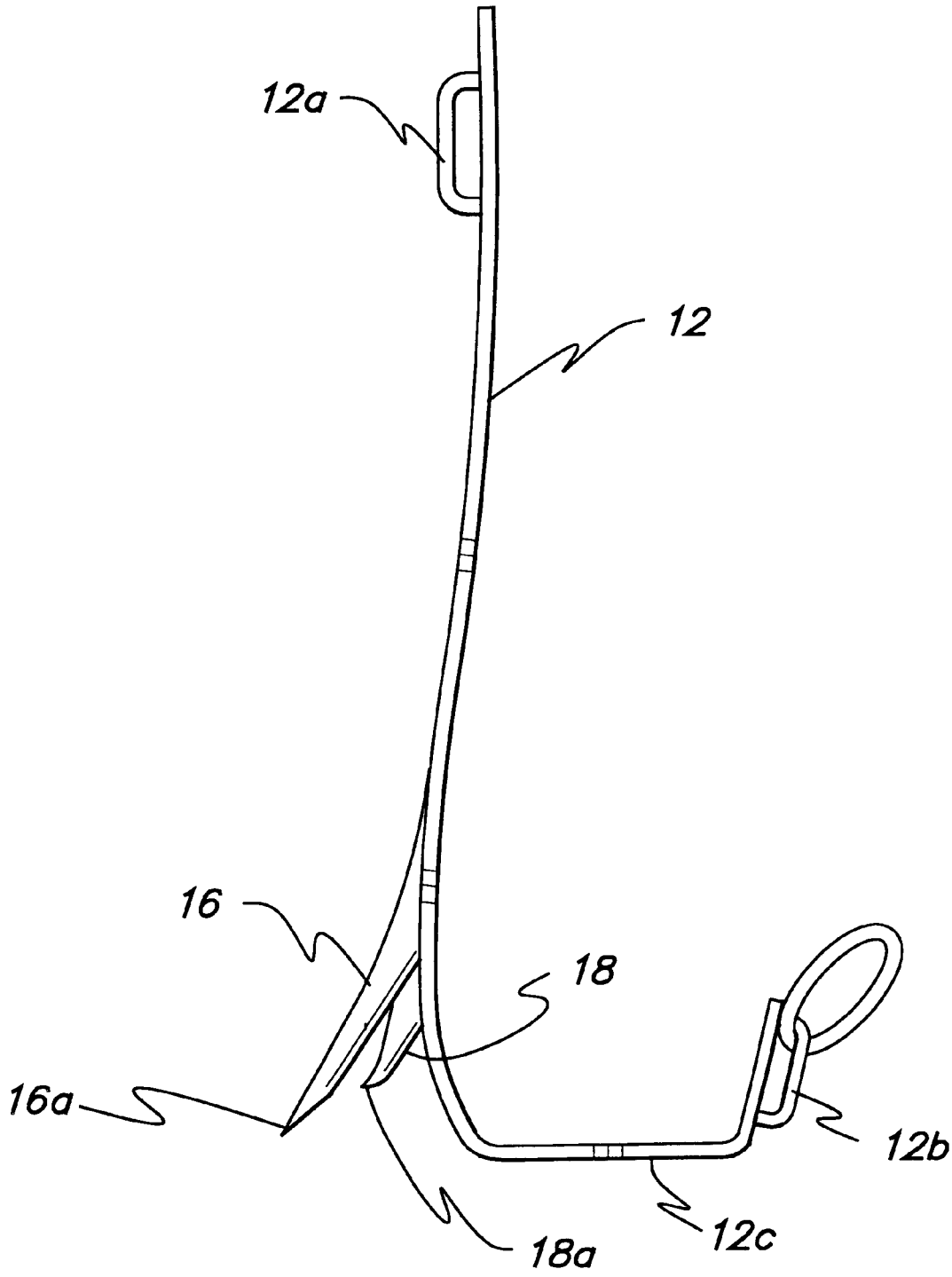
FIG. 2 is a front view of a tree-climbing gaff according to the present invention.
Figure 3:
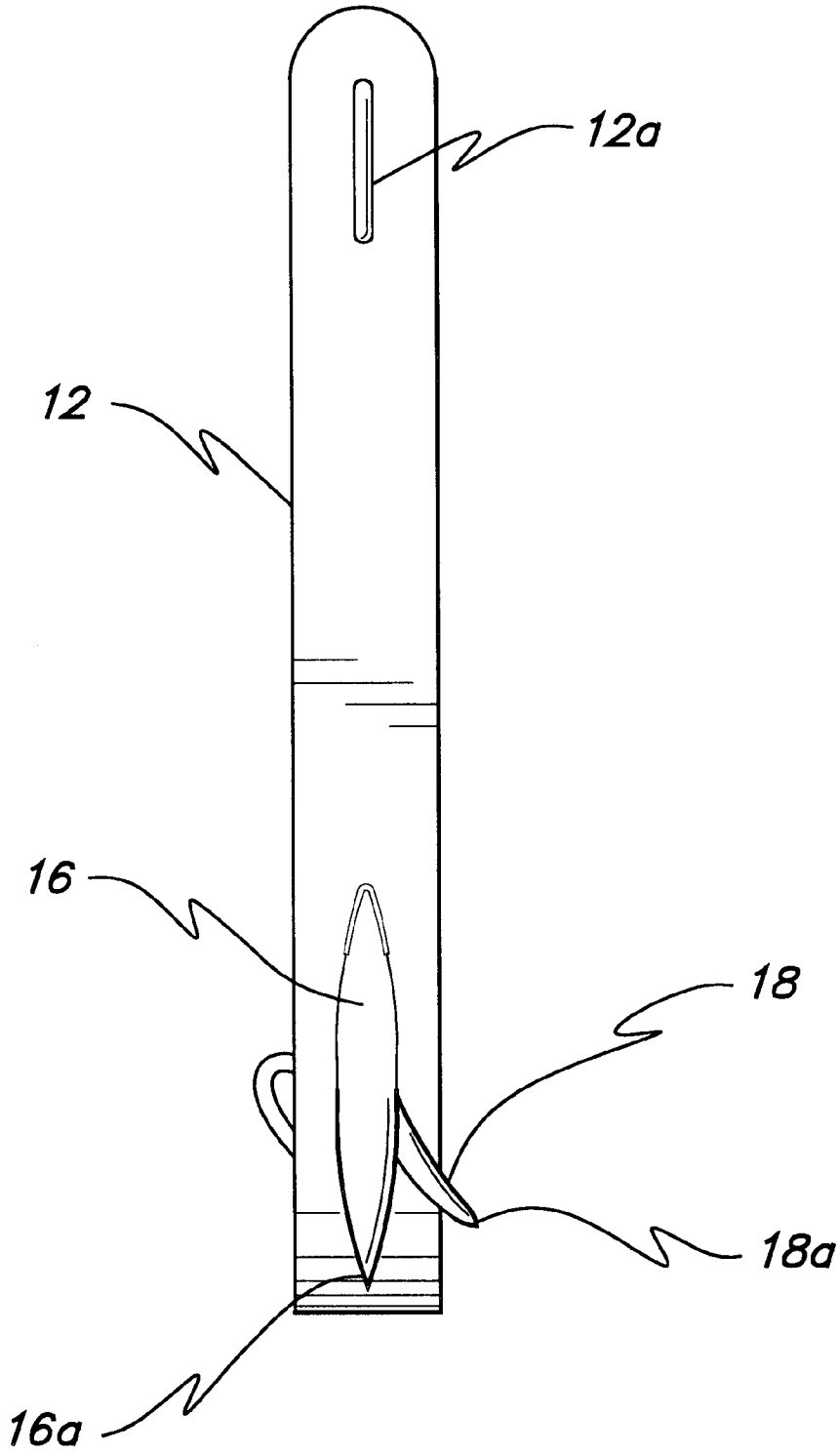
FIG. 3 is a side view of a tree-climbing gaff according to the present invention.

The present invention is a climbing device generally indicated at 10 which is adapted to be attached to the legs and feet of a user. FIG. 1 is illustrative of such attachment to the left leg and foot. Attachment to the right leg and foot would mirror the showing of FIG. 1. As shown, a stirrup-like member 12 is provided with loops 12*a*, 12*b*. A pair of straps 14*a*, 14*b* (shown in phantom lines) is threaded through loops 12*a*, 12*b* and around boot B of a wearer. Straps 14*a*, 14*b* are adjustable to accommodate different boot sizes. A pad 15 fabricated of a pliable, rugged material (leather or the like) may be disposed on the device for further support and comfort. As best seen in FIG. 2, member 12 is fabricated from high strength metal bar stock which is bent at the lower end to form a stirrup portion 12c. Member 12 is designed to extend from beneath the instep of the boot to a position at least above the ankle. A primary tapered, metal prong (gaff) 16, having a sharp cutting point 16a at its free end, is attached at the side of member 12 opposite loop 12*b* and extends angularly away from member 12. A secondary tapered metal prong 18, unitary with primary prong 16, has a sharp cutting point 18*a* fashioned at its free end. Prong 18 also extends angularly away from member 12 but at an angle approximately half that of prong 16. For optimum results, it has been determined that the angle formed between member 12 and primary prong 16 should be approximately forty-five degrees and the angle formed between member 12 and secondary prong 18 should be approximately seventeen degrees. Further, it has been found that the device is most effective when the secondary prong 18 is angled forwardly of prong 16 toward the toe of the boot (or leading edge of member 12), as illustrated in FIG. 3. The forward angle of inclination of prong 18 is approximately forty five degrees. End 18*a* of prong 18 is provided with a slight, upwardly-directed curvature. Prong 18 is half the length of the primary prong 16. In the preferred embodiment, primary prong 16 is about three inches long and secondary prong 18 is about one and one-half inches long. The unitary structure defining prongs 18 and 16 may be attached to member 12 by any efficient method (welding, bolts, etc.) thus, allowing for easy adaptation to an existing stirrup member.

It is to be understood that the present invention is not limited to the embodiment described above, but encompasses any and all embodiments within the scope of the following claims.

I claim:

1. A tree-climbing device comprising:

an elongate metal bar having a substantially vertical section with an upper end, a lower end, an inner side and an outer side, the lower end of said bar being bent to form a substantially horizontal stirrup portion with a leading edge;

a primary metal prong having a first end attached to the outer side of the vertical section of said bar proximate the lower end and a pointed second end, said primary prong further having a first length and extending downwardly and outwardly from the vertical section of the bar to define a first angle; and a secondary metal prong having one end and an opposite pointed end, the one end of said secondary prong being integrally joined at the first end directly beneath said primary prong to form a unitary structure, said secondary prong further having a second length and extending downwardly and outwardly from the vertical section of the bar to define a second angle, the second length of said secondary prong being about half the first length of the primary prong and the second angle is approximately half that of the first angle;

said secondary prong also extending forwardly off center of said primary prong toward the leading edge of said stirrup portion to define a third angle.

2. The tree-climbing device according to claim 1, wherein said first angle is about forty-five degrees, said second angle is about seventeen degrees and said third angle is about forty-five degrees.

3. The tree-climbing device according to claim 1, wherein the first length of said primary prong is approximately three inches and the second length of said secondary prong is approximately one and one-half inches.

4. The tree-climbing device according to claim 1, further including a first loop member disposed on the outer side of said bar adjacent the upper end, and a second loop member disposed on said stirrup portion.

* * * * *